US007822181B2

(12) United States Patent
Teodorescu

(10) Patent No.: US 7,822,181 B2
(45) Date of Patent: Oct. 26, 2010

(54) RADIATION COLLIMATOR

(75) Inventor: Horia Mihail Teodorescu, Currier House, Harvard College, Cambridge, MA (US) 02138

(73) Assignee: Horia Mihail Teodorescu, Cambridge, MA (US)

( * ) Notice: Subject to any disclaimer, the term of this patent is extended or adjusted under 35 U.S.C. 154(b) by 0 days.

(21) Appl. No.: 12/220,777

(22) Filed: Jul. 29, 2008

(65) Prior Publication Data

US 2010/0027755 A1 Feb. 4, 2010

(51) Int. Cl.
*G21K 1/02* (2006.01)

(52) U.S. Cl. ..... 378/147

(58) Field of Classification Search ..... 378/147; 250/505.1

See application file for complete search history.

*Primary Examiner*—Jurie Yun

(57) ABSTRACT

A radiation collimator for use in either radiation-emitting devices (e.g., radiation therapy) or radiation-sensing imagery devices (i.e., gamma/X-ray cameras) is disclosed. The collimator's interior surface is basically a cylinder or a truncated cone, whereas its exterior shape is generated by the revolution of the graph of a function about the cylinder's symmetry axis, that function being determined such that the attenuation in the center of the sensor is constant as seen from any direction. The collimator is a body of revolution. The said collimator improves collimation and image resolution when compared to cylindrical, pinhole, laminar, or to other art collimators.

4 Claims, 6 Drawing Sheets

RADIATION COLLIMATOR

FIELD OF INVENTION

The field of the invention relates to collimators for nuclear instrumentation, such as gamma cameras and gamma knives, with applications in the fields of medical imagery and radiosurgery, and in the field of industrial materials quality testing (i.e., crack detection), moreover in X- or gamma-ray astronomy.

BACKGROUND OF THE INVENTION

Radiation collimators are used in a multitude of applications, including focused or directional radiation emission or radiation imagery and sensing. Radiation imagery applications include gamma and X-ray cameras and devices utilizing radiation camera settings. Radiation emission applications include radiation therapy devices, such as the gamma knife (U.S. Pat. No. 6,968,036), or the Linac (U.S. Pat. No. 6,459,769B1). Other applications, such as industrial material quality testing and crack detection (U.S. Pat. No. 4,680,470) utilize radiation imagery as well as radiation emission, both requiring the use of collimators. The art uses collimators in a variety of spatial or structural arrangements or distributions, such as hemispheres (U.S. Pat. No. 6,968,036 B2; U.S. Pat. No. 5,448,611), linear distributions, or "fan-beam" collimators (GB 1,126,767; JP20002318283). Widely used are cylindrical collimators and pinhole collimators (U.S. Pat. No. 4,348,591; U.S. Pat. No. 6,114,702), in a variety of spatial distributions (U.S. Pat. No. 5,270,549). Recent applications disclose laminar/superposed adjustable collimators (U.S. Pat. No. 5,436,958), single-leaf elliptical collimators (WO 2006/015077A1), or multi-leaf adjustable collimators (U.S. Pat. No. 6,388,816 B2; U.S. Pat. No. 6,714,627; U.S. Pat. No. 7,095,823 B2). However, none of these art collimator designs takes into account the radiation attenuation law (i.e., the attenuation is proportional to the inverse exponential of the shielding thickness through which the radiation passes) in assessing the directivity characteristic (radiation diagram) of the collimators. These limits affect the directional precision in the case of radiation emitters and the resolution in the case of imagery applications (Teodorescu).

Conchoids have frequently been used in patents, but never in the art of radiation collimators. Patents include using conchoids for clock mechanisms (U.S. Pat. No. 6,809,992), for metal cutting tools (U.S. Pat. No. 2,053,392), for antenna steering devices (U.S. Pat. No. 6,766,166), for tape recorders (U.S. Pat. No. 3,443,447), as well as for optical lenses (U.S. Pat. No. 880,208). Other publications illustrate the use of the Nicomedes conchoid in optimization problems, such as in (Kacimov).

BRIEF SUMMARY OF THE INVENTION

The object of this invention is a radiation collimator whose shape ensures constant attenuation to rays from any direction entering the center of the collimator's base. The disclosed collimator that ensures the constant attenuation is of conchoidal shape. Precisely, the collimator is a revolution body that has a central cylindrical hole and has the outer upper surface generated by rotating a conchoidal curve around the axis of the cylinder. This collimator is intended for using a single radiation sensor or single radiation source. Multi-collimator structures based on the single sensor/source collimator are also disclosed.

DETAILED DESCRIPTION OF THE INVENTION

It is the object of this invention to provide a collimator with improved directional precision by ensuring a constant attenuation from all directions in the center of the collimator's base.

Figure 1:
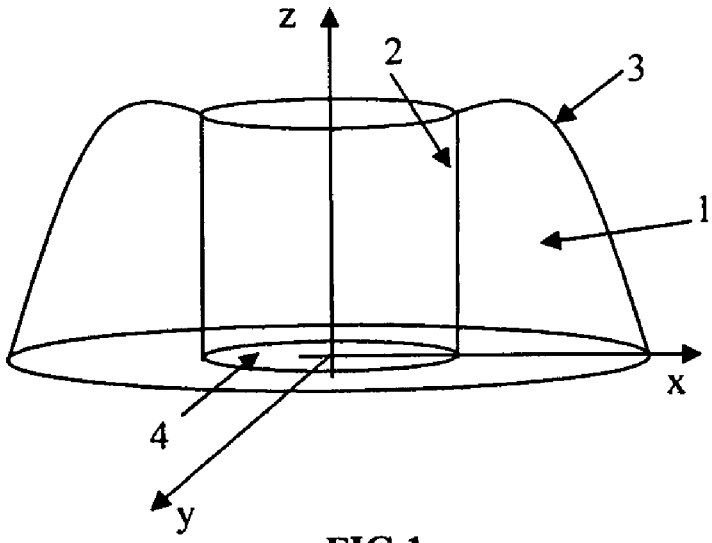
FIG. 1 is a schematic view of the axial section of the collimator, as delimited to the interior by a cylinder and to the exterior by a surface of revolution obtained by rotating a function g about the axis of the said cylinder.

As shown in FIG. 1, we assume that the interior surface of the collimator 1 is a cylindrical surface 2, while its exterior is an object of revolution obtained by revolving function g(x) 3 about axis Oz. We also assume that the empty cylinder delimited by surface 2 has radius much smaller than the height of the cylinder. Therefore, we assume that the point in the center of the circular base is representative for all the surface of the base. The goal is to obtain in the center O of the base 4 of the collimator 1 a constant attenuation, that is, attenuation independent of the angle of incidence of the radiation. A sensor or a radiation emitter, depending on the application, is placed at the base of the collimator, inside the cylindrical hole. In order to achieve the goal of constant attenuation, the problem of finding a suitable function g is solved as follows.

Figure 2:
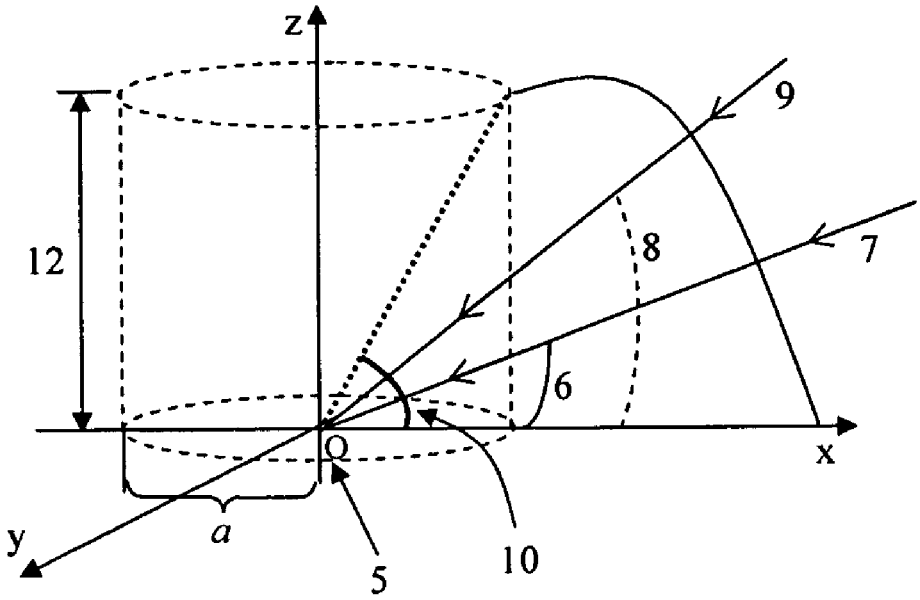
FIG. 2 illustrates rays entering the collimator at different angles of incidence $\theta_i$. Since the rays pass through different thicknesses, according to the attenuation law, they will reach the sensor in O with different intensities.

According to the attenuation law, $$\Phi(\theta)=\Phi_0 \cdot e^{-\lambda \cdot \delta(\theta)}$$

the radiation attenuation depends on the thickness of the attenuating material traversed by the radiation, $\delta(\theta)$, and on the material-dependent attenuation coefficient $\lambda$. $\Phi(\theta)$ denotes the radiation flux entering point O 5 at angle of incidence θ 11 (Φ(θ) is the attenuated flux), while $\Phi_0$ denotes the incident flux. Different incidence angles, as measured in a plane section containing the horizontal Ox and the vertical Oz axes, are depicted in FIG. 2. We assume that the radiation arrives only from the upper semi-space (upper part of the space in FIG. 2), as delimited by the "bottom" plane xOy. The ray at angle of incidence $\theta_1$ 6 is denoted as $d_1$ 7, the ray entering at angle $\theta_2$ 8 as $d_2$ 9, and the maximum angle of incidence $\theta_{Max}$ is shown as 10. Here we have considered as two construction parameters for the collimator the angle $\theta_{Max}$ 10, and the radius of the cylinder a. The height of the interior cylinder, here depicted as L 12, depends on the embodiment. In the non-limitative description of the collimator in FIG. 2, L is obtained from $\tan \theta_{Max}=L/a$.

Figure 3:
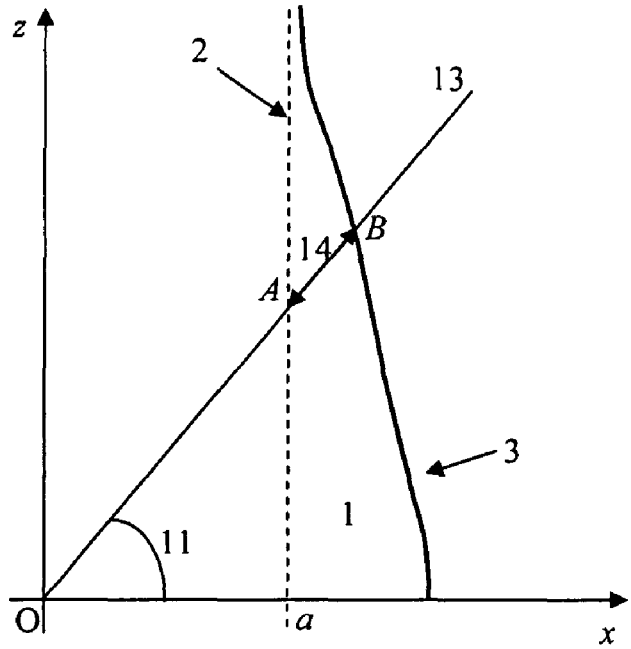
FIG. 3 represents a sectional view of the collimator, sectioned with a plane parallel to zOx. The thickness function $\delta(\theta)$ is illustrated.
Figure 4A:
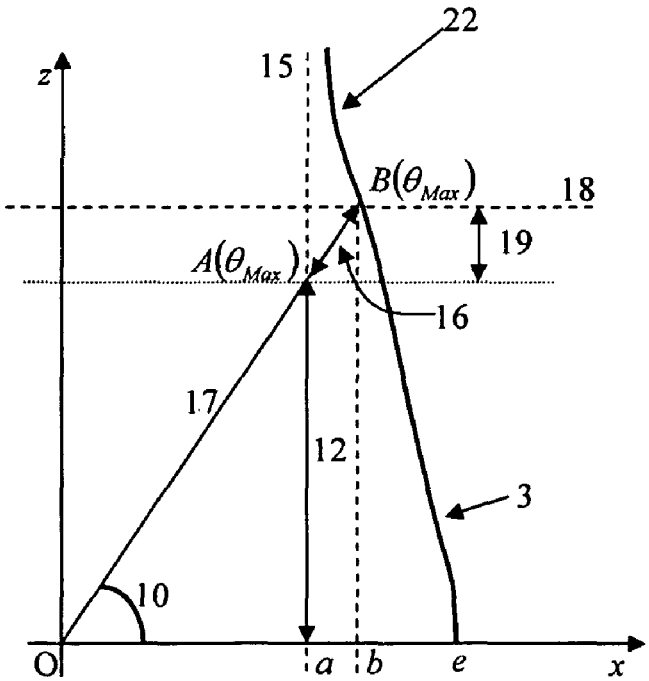
FIG. 4A represents a sectional view of the conchoidal collimator, illustrating the maximum radiation incidence angle $\theta_{Max}$.
Figure 4B:
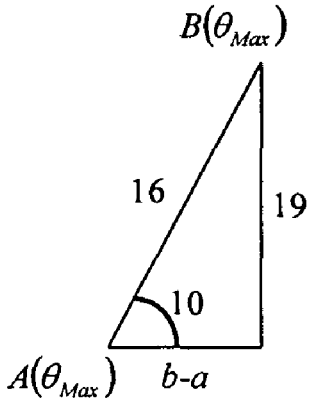
FIG. 4B represents a detailed view of part of FIG. 4A, illustrating some of the geometrical parameters of the collimator.

The principle of the invention is that constant attenuation is obtained if the distance function (i.e., thickness of attenuating material) δ(θ) 14 is invariant to the incidence angle θ 11. The geometry is depicted in FIG. 3, where the function g 3 has to be determined. FIG. 3 depicts a sectional view of the collimator, sectioned with the plane zOx. Since the collimator is a revolution body, it has axial symmetry. We denote by A the point of intersection of the ray Δ(θ) 13 with the cylinder 2 and by B the point of intersection of the ray Δ(θ) with the graph of the function g 3 delimiting the outer surface of the collimator 1. The distance function δ(θ) 14 is the Cartesian distance between points A(θ) and B(θ):

$$\delta(\theta)=\sqrt{(x_B-x_A)^2+(g(x_B)-z_A)^2}$$

since $z_B=g(x_B)$. The condition for attenuation independent of the incidence angle is that δ(θ) is constant, $\delta(\theta)=\delta_0$. The construction parameters for the collimator are $\delta_0$ 16, a, and $\theta_{Max}$ 10, as shown in FIGS. 4A and 4B.

The mathematical problem can be stated as follows: let d 15 be a fixed line and Δ(θ) 13 a line rotating around point O; find the geometric locus of the points B that are found on the line Δ(θ) such that the distance from the intersection point A of lines Δ and d to the point B is the constant $\delta_0$ 16. The solution to this geometric locus problem is known as the conchoid of Nicomedes. The angle θ 11 has been defined as the angle between the Ox axis and line Δ(θ). The distance AB is what we have defined as δ(θ) 14 and the condition imposed has been that $\delta(\theta)=\delta_0$, where $\delta_0$ 16 and the fixed line d 15 define the conchoid. The solution to finding function g(x) that satisfies the condition $\delta(\theta)=\delta_0$ is known, (Szmulowicz), (Miller), as the function corresponding to the Nicomedes conchoid, which in polar coordinates has the equation:

$$R(\theta)=\frac{a}{\cos\theta}+\delta_0$$

By methods well known to those skilled in the art, the Cartesian coordinates equation for the function g(x) can be obtained by using the conversion from polar to Cartesian coordinates, using $R(\theta)=\sqrt{x^2+z^2}$ and $$\cos\theta=\frac{x}{\sqrt{x^2+z^2}}:$$

$$z^2=\frac{x^2\cdot\lfloor\delta_0^2-(x-a)^2\rfloor}{(x-a)^2},$$

where z=g(x), and a is the radius of the inner cylinder 2 of the collimator (corresponding to rotating the line 15 d:x=a). This is a fourth order algebraic equation with solution in z represented by two curves. Only the upper curve (positive z) is of interest here.

The equation of the revolution surface is obtained by replacing x in the above formula with $r=\sqrt{x^2+y^2}$:

$$z(x,y)=\sqrt{\frac{(x^2+y^2)\cdot\left[\delta_0^2-\left(\sqrt{x^2+y^2}-a\right)^2\right]}{\left(\sqrt{x^2+y^2}-a\right)^2}}.$$

The above equation will be referred herein as the Cartesian equation of the conchoid. The Nicomedes conchoid has an asymptotical tendency 22 to infinity (with d 15 as the asymptote) when $\theta\rightarrow\pi/2$. This asymptotical tendency is shown in FIG. 4A. From a practical perspective, the collimator's height is limited by the construction parameter $\theta_{Max}$ 10. There are two embodiments that depend on whether or not the revolution of the line $\Delta(\theta_{Max})$ 17 plays a role in delimiting the collimator body. The first embodiment has a cylindrical hole terminated with a cone frustum, the said cone frustum starting at the height determined by the intersection of the line $\Delta(\theta_{Max})$ 17 with the cylindrical surface. The second embodiment is obtained for a collimator that has a cylinder as its interior surface, the said cylinder being cut by a plane parallel to xOy (the said plane obtained through the rotation around the Oz axis of line d' 18 passing through $B(\theta_{Max})$ and parallel to Ox axis). Three embodiments of collimators are described subsequently; the first two represent single-hole collimators; the third represents a preferred embodiment for an array of collimators that, when merged, compose a multi-hole collimator.

Figure 5:
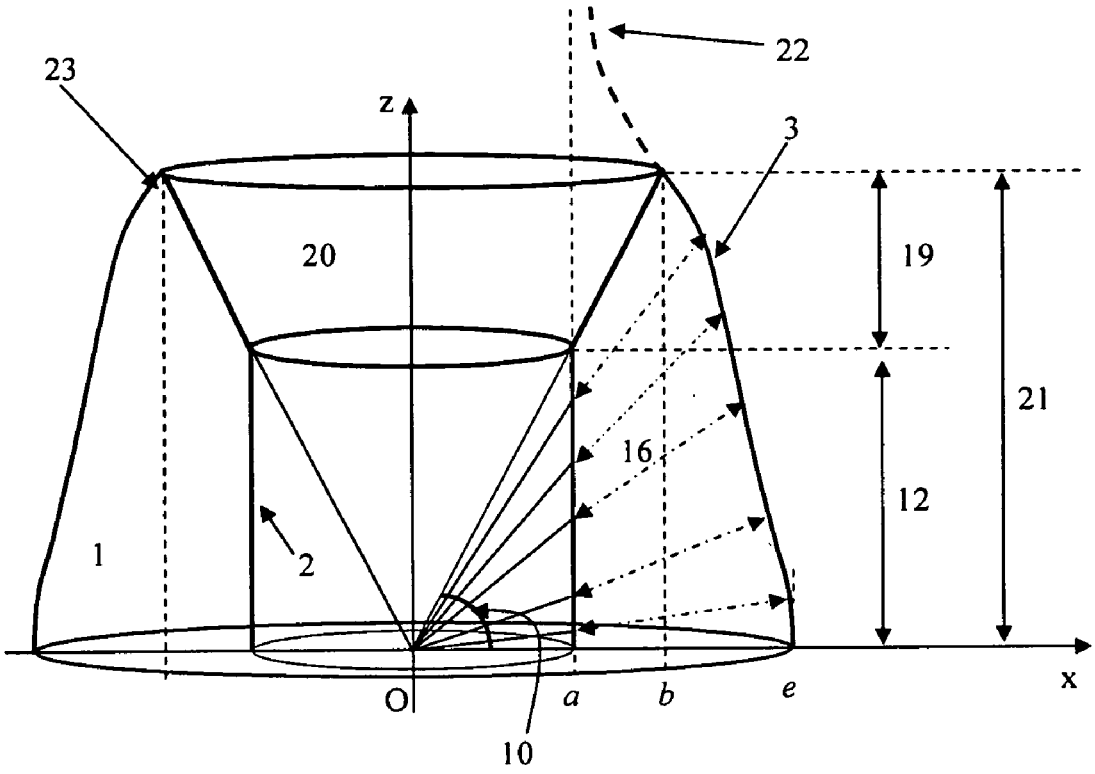
FIG. 5 represents the first preferred embodiment, a conchoidal collimator with a cylindrical hole terminated in a cone frustum.
Figure 6:
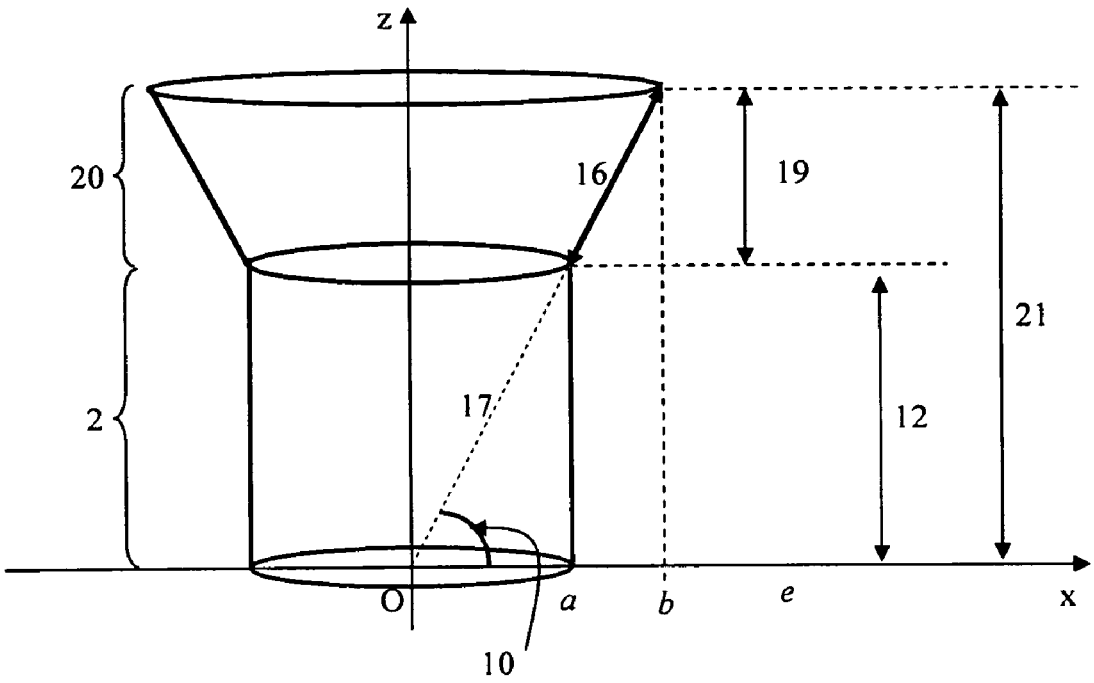
FIG. 6 shows a detail of the said collimator hole for the first preferred embodiment.

In a first preferred embodiment, the collimator body 1 is defined as a body of revolution, delimited to the exterior by the surface of revolution having as generator a Nicomedes conchoid 3, while its interior surface delimited by the cylinder 2 of radius a and height L 12 on top of which is a cone frustum 20 obtained by the revolution of the line $\Delta(\theta_{Max})$ 17 around the axis Oz of the said cylinder. The collimator has axial symmetry. This embodiment is shown in FIG. 5. The effective height 21 of the collimator is H:

$$H=L+h,$$

where $L=a\cdot\tan(\theta_{Max})$ 12 is the height of the interior cylinder 2 and $h=\delta_0\cdot\sin(\theta_{Max})$ 19 is the height of the interior cone frustum 20. The cylinder and the frustum are empty and represent the hole of the collimator, shown in FIG. 6. The function f(x, y) is a piecewise function, where the interval [0,a]×[0, a] represents the empty interior cylinder, the interval [a, b]×[a, b] the cone frustum, and the interval [b, e]×[b, e] the conchoidal surface. The constants b, and e are represented in FIGS. 5 and 6 and are defined as follows:

$$b=a+\delta_0\cdot\cos(\theta_{Max})$$

$$e=a+\delta_0,$$

where a, $\delta_0$, and $\theta_{Max}$ are the collimator construction parameters.

The function z=f(x, y) that defines the collimator body as an object of revolution has value 0 for the interval [0, a]x[0, a], which corresponds to the empty interior cylinder. For the interval [a, b]x[a, b], which corresponds to the cone frustum, the function $f$ takes the z-value of the line $\Delta(\theta_{Max})$. The exterior surface of the collimator is defined as the surface of revolution having as generator a conchoid. For the interval [b, e]×[b, e], the function $f$ takes values according to the conchoid defined in the Cartesian equation of the conchoid. The collimator function z=f(x, y) is:

$$z = f(x, y) = \begin{cases} 0, & \text{for } \sqrt{x^2+y^2} \in [0, a) \cup [e, +\infty) \\ \left(\sqrt{x^2+y^2} - a\right)\cdot\left(\frac{H-L}{b-a}\right) + H, & \text{for } \sqrt{x^2+y^2} \in [a, b) \\ \sqrt{\frac{(x^2+y^2)\cdot\left[\delta_0^2 - \left(\sqrt{x^2+y^2} - a\right)^2\right]}{\left(\sqrt{x^2+y^2} - a\right)^2}}, & \text{for } \sqrt{x^2+y^2} \in [b, e) \end{cases}$$

The attenuation function A(θ) is defined as the ratio incident flux $\Phi_0$/attenuated radiation flux received in O, Φ(θ). Using the attenuation law, A(θ) is:

$$A(\theta) = \frac{\Phi_0}{\Phi(\theta)} = \frac{\Phi_0}{\Phi_0 \cdot e^{-\lambda\cdot\delta_0}} = e^{\lambda\cdot\delta_0}$$

For the current embodiment, no attenuation is achieved for angles larger than $\theta_{Max}$:

$$A(\theta) = \begin{cases} e^{\lambda\cdot\delta_0}, & \text{for } \theta \le \theta_{Max} \\ 1, & \text{for } \theta > \theta_{Max} \end{cases}$$

Figure 7:
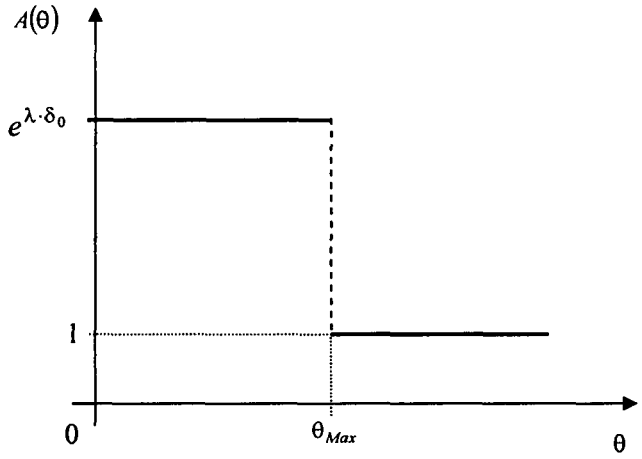
FIG. 7 represents the attenuation profile for the first preferred embodiment.

The attenuation profile for the current embodiment is shown in FIG. 7. While the current embodiment ensures a constant attenuation profile for all incidence angles $f \leqq \theta_{Max}$ the collimator presents several structural issues. The sharp edge 23 of the cone frustum 20 makes the structure brittle. Moreover, machining the cone frustum collimator hole is more complex than machining a cylindrical hole. The structural concerns are solved in a second preferred embodiment.

Figure 8A:
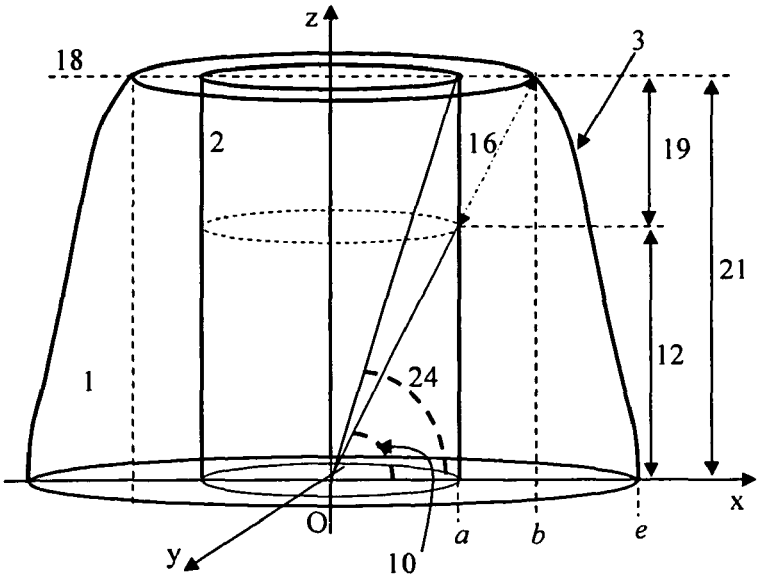
FIG. 8A represents the second preferred embodiment, a conchoidal collimator with cylindrical hole.
Figure 8B:
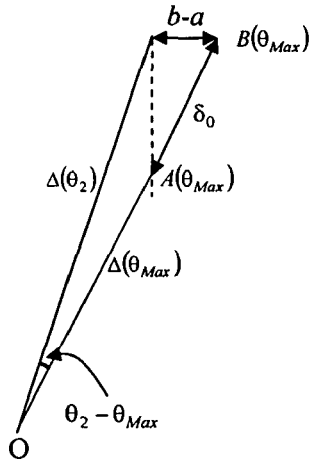
FIG. 8B presents a detailed view of part of FIG. 8A, illustrating some of the geometrical parameters of the collimator for the second preferred embodiment.

In a second preferred embodiment, the collimator shape is delimited to the interior by an empty cylinder 2 and to the exterior by the revolution of the Nicomedes conchoid 3. The collimator 1 is a body of revolution. In this preferred embodiment, the collimator hole does not include a cone frustum. The line d' 18 parallel to the Ox axis and passing through $B(\theta_{Max})$ is revolved about the cylinder symmetry axis Oz thus delimiting with a plane parallel to xOy the collimator body in the semi-space above plane xOy. The second preferred embodiment is shown in FIG. 8. In this preferred embodiment, the collimator's interior surface is a cylinder of radius a and height H 21. The construction parameter $\theta_{Max}$ 10 corresponds to the maximum incidence angle of the radiation that is attenuated. The construction parameters a, $\theta_{Max}$10, and $\delta_0$ 16 determine $L=a\cdot\tan\theta_{Max}$ 12, as well as $h=\delta_0\cdot\sin(\theta_{Max})$ 19. The height of the interior cylinder is, in this preferred embodiment:

$$H=L+h=a\cdot\tan(\theta_{Max})+\delta_0\cdot\sin(\theta_{Max})$$

The function z=f(x, y) that defines the collimator body as an object of revolution in this second preferred embodiment takes value 0 for the interval [0, a]×[0, a], which corresponds to the empty interior cylinder. For the interval [a, b]×[a, b], function $f$ takes value H, while for the interval [b, e]×[b, e] the function $f$ takes values according to the Cartesian equation of the conchoid. The collimator function z=f(x, y) is:

$$z = f(x, y) = \begin{cases} 0, & \text{for } 0 < \sqrt{x^2+y^2} < a \\ H = a\cdot\tan(\theta_{Max}) + \delta_0\cdot\sin(\theta_{Max}), & \text{for } a \le \sqrt{x^2+y^2} < a + \delta_0\cdot\cos(\theta_{Max}) \\ \sqrt{\frac{\left[\delta_0 - \left(\sqrt{x^2+y^2} - a\right)^2\right]\cdot(x^2+y^2)}{(x-a)^2}}, & \text{for } a + \delta_0\cdot\cos(\theta_{Max}) \le \sqrt{x^2+y^2} < a + \delta_0 \\ 0, & \text{for } \sqrt{x^2+y^2} \ge a + \delta_0 \end{cases}$$

For the current embodiment, constant attenuation is achieved for angles $\theta \leqq \theta_{Max}$. Compared to the first embodiment, for incidence angles slightly larger than $\theta_{Max}$ a small attenuation is still obtained. For angles of incidence $\theta_{Max} \leqq \theta \leqq \theta_2$ non-uniform attenuation, dependent on θ, is obtained:

$$A(\theta) = \begin{cases} e^{\lambda\cdot\delta_0}, & \text{for } 0 \le \theta \le \theta_{Max} \\ e^{\lambda\cdot\delta(\theta)}, & \text{for } \theta_{Max} < \theta \le \theta_2, \\ 1, & \text{for } \theta > \theta_2 \end{cases}$$

where $$\theta_2 = \arctan\frac{H}{a} \quad 24,$$

$H=a\cdot\tan(\theta_{Max})+\delta_0\cdot\sin(\theta_{Max})$ 21, and δ(θ) is:

$$\delta(\theta) = \frac{H - a\cdot\tan\theta}{\sin\theta} \quad \text{for } \theta_2 > \theta > \theta_{Max}.$$

Note that δ(θ) is the constant $\delta_0$ 16 for angles $0 \leqq \theta \leqq \theta_{Max}$. For angles $\theta_{Max} < \theta \leqq_2$ the attenuation A(θ) decreases from $e^{\lambda\cdot\delta_0}$ to 1. The second embodiment produces a small attenuation for angles slightly larger than $\theta_{Max}$, with no significant effect on the directivity of the collimator.

In both embodiments the plane xOy delimits the collimator body in the lower semi-space. The skilled reader will understand that the collimator shape described above can be completed by a thick slab (backplate) of thickness $\delta_0$, or larger, to suppress incoming or outgoing background radiation.

Figure 9:
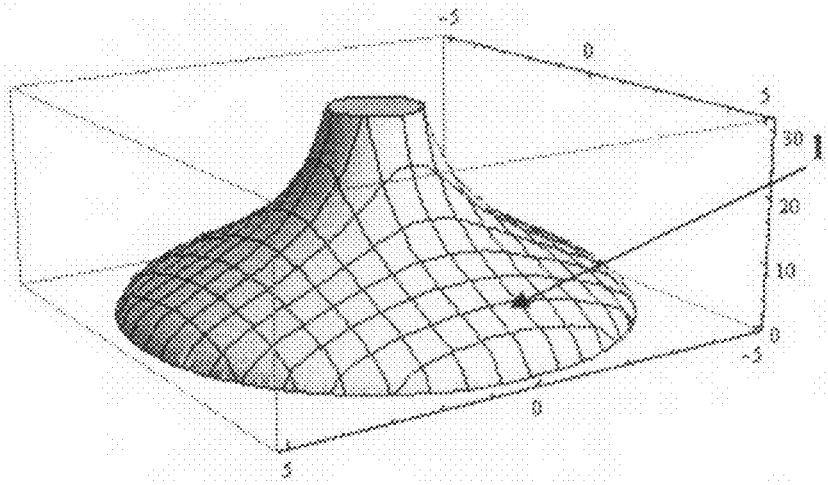
FIG. 9 represents a three-dimensional view of the conchoidal collimator.
Figure 10:
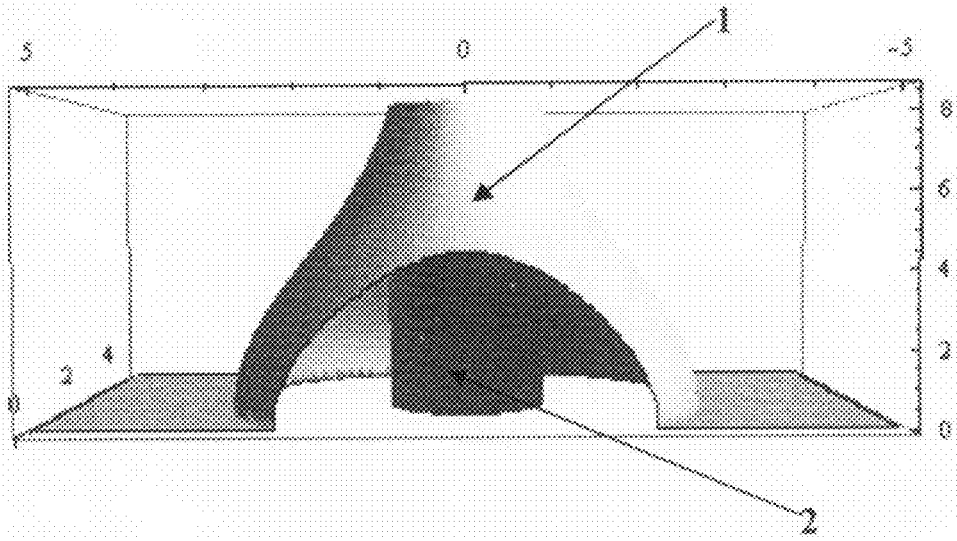
FIG. 10 is a view in section of the collimator depicted in FIG. 10. The section is made with a plane parallel to zOx. The interior cylinder 2 of the collimator 1 is illustrated.

In the first and second preferred embodiments, a single collimator 1 as seen in FIG. 9 can be used for radiation imaging (i.e., gamma camera), or radiation emitting (i.e., gamma knife) purposes. FIG. 10 presents the same collimator 1 in a sectional view (sectioned with a plane parallel to zOx), showing the interior of the collimator. The collimator is filled with radiation attenuating materials (such as lead or composites), known to the art, which are not the object of this invention and will not be discussed. Several elementary collimators as the one described above can be used in combination, in order to obtain collimator arrays for sensor arrays or for radiation sources arrays.

Figure 11:
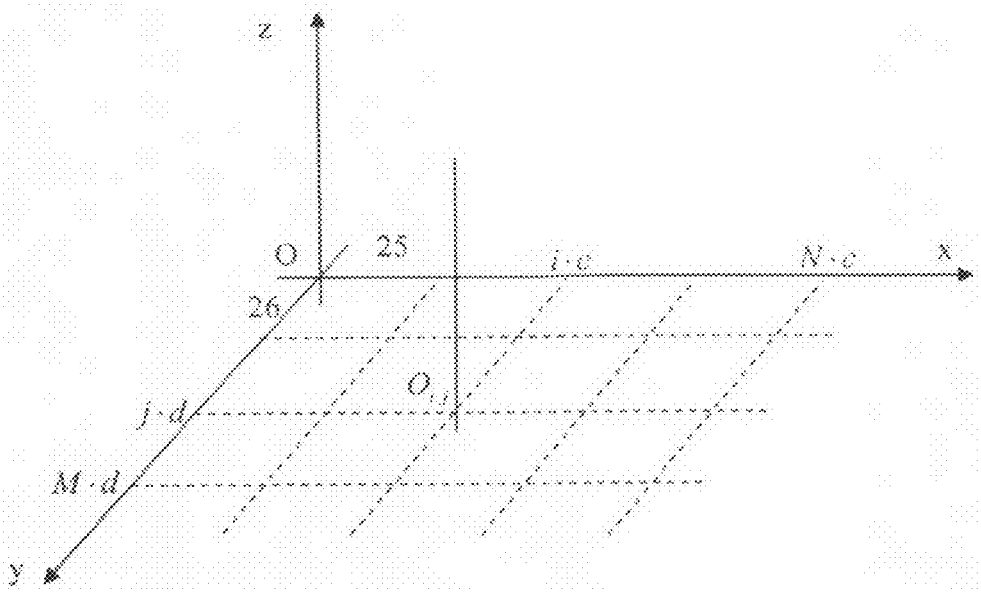
FIG. 11 represents a schematic view of an array of collimators.

A third preferred embodiment consists in a planar array of collimators used for applications in multiple-beam gamma knives or multiple-collimator gamma cameras. In this embodiment, several collimators are merged to form a single body. The parameters for the array, c 25 on the Ox axis and d 26 on the Oy axis, determine the distance at which the rotation axis of the collimator is compared to other collimators that are part of the array, as shown in FIG. 11. Considering an array with a row of N collimators (N collimators on the Ox axis) and a column of M collimators (M collimators on the Oy axis), let us denote by $f_{00}(x, y)$ the function representing the upper exterior surface of the first collimator, centered at O(0; 0). We denote by $f_{i\,j}(x, y)$ the function of a collimator centered at $O_{i\,j}(i{\cdot}c; j{\cdot}d)$. By centered at $O_{i\,j}$, we understand that the axis of revolution of the collimator $f_{i\,j}$ passes through $O_{i\,j}$ $(i{\cdot}c; j{\cdot}d)$. The collimator array thus constructed is N collimators wide (range for $i \in \{1, 2, \ldots, N\}$) and M collimators deep (range for $j \in \{1, 2, \ldots, M\}$).

Figure 12:
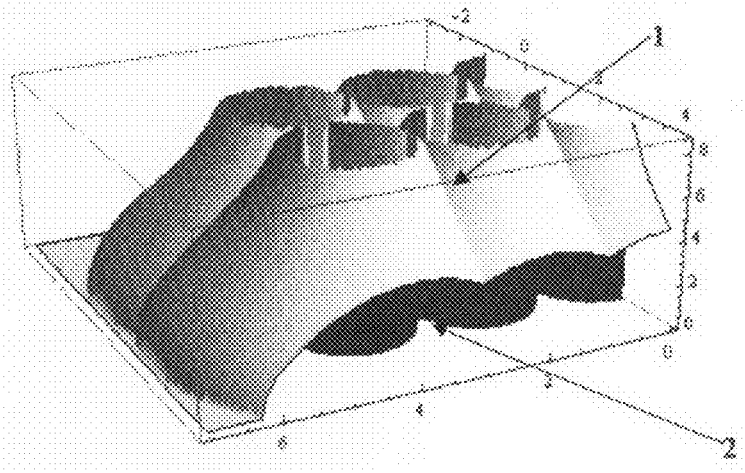
FIG. 12 is a three-dimensional view of an array of merged conchoidal collimators.

While each single collimator in the array may be obtained as an object of revolution, the array itself is not an object of revolution. Moreover, since adjacent collimators to the one corresponding to $f_{i\,j}$ (i.e., $f_{i-1;\,j}$, $f_{i;\,j-1}$, $f_{i-1;\,j-1}$, $f_{i;\,j+1}$, $f_{i+1;\,j+1}$, $f_{i+1;\,j}$) may overlap to portions of collimator $f_{i\,j}$, the upper surface of the array does not have axial symmetry. The array, while not a revolution body, is upper-bounded by the graph of the function $f_{array}(x, y)$. The function $f_{array}(x, y)$ is defined as the maximum of all the functions $f_{i\,j}$ corresponding to the individual collimator functions, with $i \in \{1, 2, \ldots, N\}$ and $j \in \{1, 2, \ldots, M\}$:

$$f_{array}(x, y) = \begin{cases} \operatorname*{Max}_{i,j}(f_{ij}), & (i;\, j) \in \{1, 2, \ldots, N\} \times \{1, 2, \ldots, M\} \\ 0, & (x - i \cdot c)^2 + (y - j \cdot d)^2 < a^2, \end{cases}$$

where the condition $f_{array}(x, y)=0$ for $(x-i{\cdot}c)^2+(y-j{\cdot}d)^2<a^2$ corresponds to the empty cylinders. An example of the function $f_{array}$ is illustrated in FIG. 12.

A multitude of collimator arrangements may be created based on values given to the array parameters c and d and on the radius a. Depending on the parameters c and d, the elementary collimators may be partially merged (overlapping), as non-limitatively depicted in FIG. 12. A sectional view of the array of collimators, the said section made with a plane parallel to zOx, is shown in FIG. 12. The array parameters act as a translation of the function $f_{00}$ by c 25 on the Ox axis and by d 26 on the Oy axis. For example, the collimator with center coordinates $O_{12}(c; 2d)$ would have the generating function $f_{12}(x, y)=f_{00}(x-c; y-2d)$.

Those skilled in the art will understand that, while the description has been done for collimators with cylindrical hole, the entire method of defining the outer surface of the collimator remains valid for collimators with frustrated cone hole, by using conchoids with respect to the generator of the said cone frustum.

Although only a few embodiments have been described in detail above, those skilled in the art can recognize that many variations from the described embodiments are possible without departing from the spirit of the invention.

Those skilled in the art will understand that the case of the collimator with cylindrical hole with circular base is only an example of the art and that a cylindrical hole with any shape of the base, moreover a prismoidal hole having a hexagonal or rectangular hole can be used instead, according to the known art in multi-leaf collimators (U.S. Pat. No. 6,388,816 B2) and in collimator arrays (U.S. Pat. No. 3,943,366). In these cases, assuming that the said collimator's hole surface is a generalized cylindrical surface, a conchoidal surface is produced as the outer collimator surface by ensuring the condition that the intersection of the said outer surface with any plane normal to the hole surface along a generator of the hole surface represents a Nicomedes conchoid curve. Also, the skilled worker will understand that approximations of the conchoid may be used instead of the exact conchoid without significant degradation of the performance of the collimator.

Those skilled in the art will also understand that, while the main purpose of this invention is to produce a collimator with constant or almost flat attenuation characteristic with respect to the incident or emergent radiation angle, a predefined attenuation characteristic can be obtained by replacing in the equation of Nicomedes' conchoid the constant 60 with the desired function h(O), $$R(\theta) = \frac{a}{\cos\theta} + h(\theta).$$

The corresponding curves that satisfy the above equation will be referred herein as generalized h-Nicomedes' conchoids, understanding that the function h(O) is pre-determined.

INDUSTRIAL APPLICABILITY

The collimator proposed may be realized by typical industrial manufacturing systems for both radiation knives and radiation cameras (X- and gamma-radiation). As an example, either single or multiple collimator configurations can be obtained by casting, or by machining a thick plate of absorbing material.

REFERENCES CITED

U.S. Patent Documents

U.S. Pat. No. 880,208 February 1908 Germain et al.
U.S. Pat. No. 2,053,392 September 1936 Challier
U.S. Pat. No. 3,443,447 May 1969 Fowler
U.S. Pat. No. 3,943,366 March 1976 Platz et al.
U.S. Pat. No. 4,348,591 September 1982 Wunderlich
U.S. Pat. No. 4,680,470 July 1987 Heald
U.S. Pat. No. 5,270,549 December 1993 Engdahl
U.S. Pat. No. 5,436,958 July 1995 Taylor
U.S. Pat. No. 5,448,611 September 1995 Kerjean
U.S. Pat. No. 6,114,702 September 2000 Doerfel
U.S. Pat. No. 6,388,816 B2 May 2002 Brown et al.
U.S. Pat. No. 6,459,769 B1 October 2002 Cosman
U.S. Pat. No. 6,714,627 B1 March 2004 Brown et al.
U.S. Pat. No. 6,766,166 B1 July 2004 Draim
U.S. Pat. No. 6,809,992 October 2004 Ermel et al.
U.S. Pat. No. 6,968,036 B2 November 2005 Carlsson et al.
U.S. Pat. No. 7,095,823 B2 August 2006 Topolnjak et al.

Foreign Patent Documents

DE 10011877 A1 September 2001 Freund et al.
GB 1,126,767 September 1968 Han

JP 20002318283 October 2002 Hiromichi
WO 20006/015077A1 February 2006 Sohal et al.

Other Publications

Miller, N., "The problem of a non-vanishing girder rounding a corner", The American Mathematical Monthly, Vol. 56, No. 3, pp. 177-179, 1949

Szmulowicz, F., "Conchoid of Nicomedes from reflections and refractions in a cone", American Journal of Physics, Vol. 64, No. 4, pp. 467-471, 1996

Teodorescu, H. M., "Effects of pseudo-lensing and pseudo-dispersion in curved radiation shields and collimators: effects on measurements", Sensors for Harsh Environments III, SPIE Proceedings, Vol. 6757, pp. 67570K-1 to 67570K-12, 2007

Kacimov, A. R., "Seepage to a drainage ditch and optimization of its shape", Journal of Irrigation and Drainage Engineering, Vol. 132, No. 6, pp. 619-622, 2006

What is claimed is:

1. A single-hole collimator for nuclear radiation consisting of a body of revolution delimited by an inner surface represented by a right, generalized cylindrical surface, an outer surface produced by a generatrix which is either a Nicomedes conchoid, a generalized Nicomedes conchoid, or a curve approximating a Nicomedes conchoid, moreover delimited by two annular surfaces determined by the intersection of the outer and inner surfaces with two planes orthogonal to the axis of revolution of the said body, the said Nicomedes conchoid being constructed with respect to the said generatrix of the said inner surface and a point placed on one of the said annular surfaces, namely on that which has the largest external radius and which is named base of the said collimator, the said cylindrical inner surface delimiting a hole in the said body of the collimator, the said body of the collimator being built of a material absorbing nuclear radiation.

2. A single-hole collimator as claimed in claim 1, the said collimator having the said inner surface represented by a circular cylindrical surface.

3. A single-hole collimator as claimed in claim 2, where the said inner surface is further processed as to create a frustrated cone section of the said hole at the distant end of the said hole, the distant end being referred to the said base of the collimator, the said frustrated cone being coaxial with the said cylindrical surface and having the larger basis of the frustrated cone placed at the distant end of the collimator.

4. An array consisting of several single-hole collimators as claimed in claim 1, arranged according to a specified planar or spatial grid, wherein the array of collimators is supported by means of a frame or other appropriate support structure.

* * * * *